US005676273A

United States Patent [19]

Jonkers et al.

[11] Patent Number: 5,676,273

[45] Date of Patent: Oct. 14, 1997

[54] CONTAINER WITH COVER LOCKABLE THEREON

[75] Inventors: Godefridus Hubertus Johannes Jonkers, Helmond; Stephanus Franciscus Schilthuizen, Berkel-Enschot, both of Netherlands

[73] Assignee: Wiva Verpakkingen B.V., Netherlands

[21] Appl. No.: 500,971

[22] PCT Filed: Nov. 25, 1994

[86] PCT No.: PCT/NL94/00298

§ 371 Date: Sep. 19, 1995

§ 102(e) Date: Sep. 19, 1995

[87] PCT Pub. No.: WO95/15914

PCT Pub. Date: Jun. 15, 1995

[30] Foreign Application Priority Data

Dec. 7, 1993 [NL] Netherlands ..... 9302132

[51] Int. Cl.[6] ..... B65D 17/52; B65D 41/36

[52] U.S. Cl. ..... 220/293; 220/284; 220/347; 220/786

[58] Field of Search ..... 220/293, 284, 220/286, 285, 315, 324, 253, 281, 780, 784, 786, 790

[56] References Cited

U.S. PATENT DOCUMENTS

| | | | |
|---|---|---|---|
| 3,407,958 | 10/1968 | Konijnenberg et al. | 220/324 X |
| 3,514,010 | 5/1970 | Rossi | 220/293 |
| 3,979,016 | 9/1976 | Frater | 220/324 X |
| 4,153,176 | 5/1979 | Carson | 220/293 X |
| 4,333,580 | 6/1982 | Sweigart, Jr. | 220/293 X |
| 4,682,688 | 7/1987 | Budert | 220/315 X |

FOREIGN PATENT DOCUMENTS 7503452 9/1976 Netherlands .

*Primary Examiner*—Allan N. Shoap
*Assistant Examiner*—Niki M. Kopsidas
*Attorney, Agent, or Firm*—Webb Ziesenheim Bruening Logsdon Orkin & Hanson, P.C.

[57] ABSTRACT

A device for closing a cover onto a container, wherein the cover and the container each have a protruding flanged edge which come to lie against each other in the closing position and wherein a hook-shaped cam connected to the cover co-acts with a counter-cam connected to the container for the purpose of locking the cover onto the container, wherein both flanged edges have continuous slotted holes in a corresponding pattern, wherein a wedge-shaped hand-tool can be placed into two mutually registering holes in the flanged edges to turn the cover in relation to the container, such that the hook-shaped cam connected to the cover comes into engagement with the counter-cam, whereby with a simple tool all locks are placed simultaneously in or out of engagement during closing or release of the cover.

7 Claims, 3 Drawing Sheets

CONTAINER WITH COVER LOCKABLE THEREON

BACKGROUND OF THE INVENTION

1. Field of the Invention

The invention relates to a device for closing a cover onto a container, wherein the cover and the container each have a protruding flanged edge which come to lie against each other in the closing position and wherein a hook-shaped cam connected to the cover co-acts with a counter-cam connected to the container for the purpose of locking the cover onto the container.

2. Description of the Prior Art

It is known to embody a cover and container with a large number of cams and counter-cams, wherein the cover must then be turned through a limited angle relative to the container in order to place the cam and counter-cam in mutual engagement. Such a closing method is usually difficult to embody for larger containers, all the more so since the cover has to be rotated with some friction relative to the container.

SUMMARY OF THE INVENTION

The invention has for its object to obviate the above stated drawback and to provide a device which is distinguished in that both flanged edges have continuous slotted holes in a corresponding pattern, wherein a wedge-shaped hand-tool can be placed in two mutually registering holes in the flanged edges for turning of the cover in relation to the container, such that the hook-shaped cam connected to the cover comes into engagement with the counter-cam.

Due to the use of a hand-tool, the body of which is substantially wedge-shaped and which can be placed in the slotted holes, turning of the cover relative to the container is considerably simplified to only pressing down the wedge-shaped handle with some force. With thus construction the cam and counter-cam also come into mutual engagement, and the closing force, which increases with the number of cams, can easily be produced by the wedge-shaped element.

BRIEF DESCRIPTION OF THE DRAWINGS

Above mentioned and other features will be further elucidated in the figure descriptions hereinbelow. In the drawings.

DESCRIPTION OF THE PREFERRED EMBODIMENT

Figure 1:
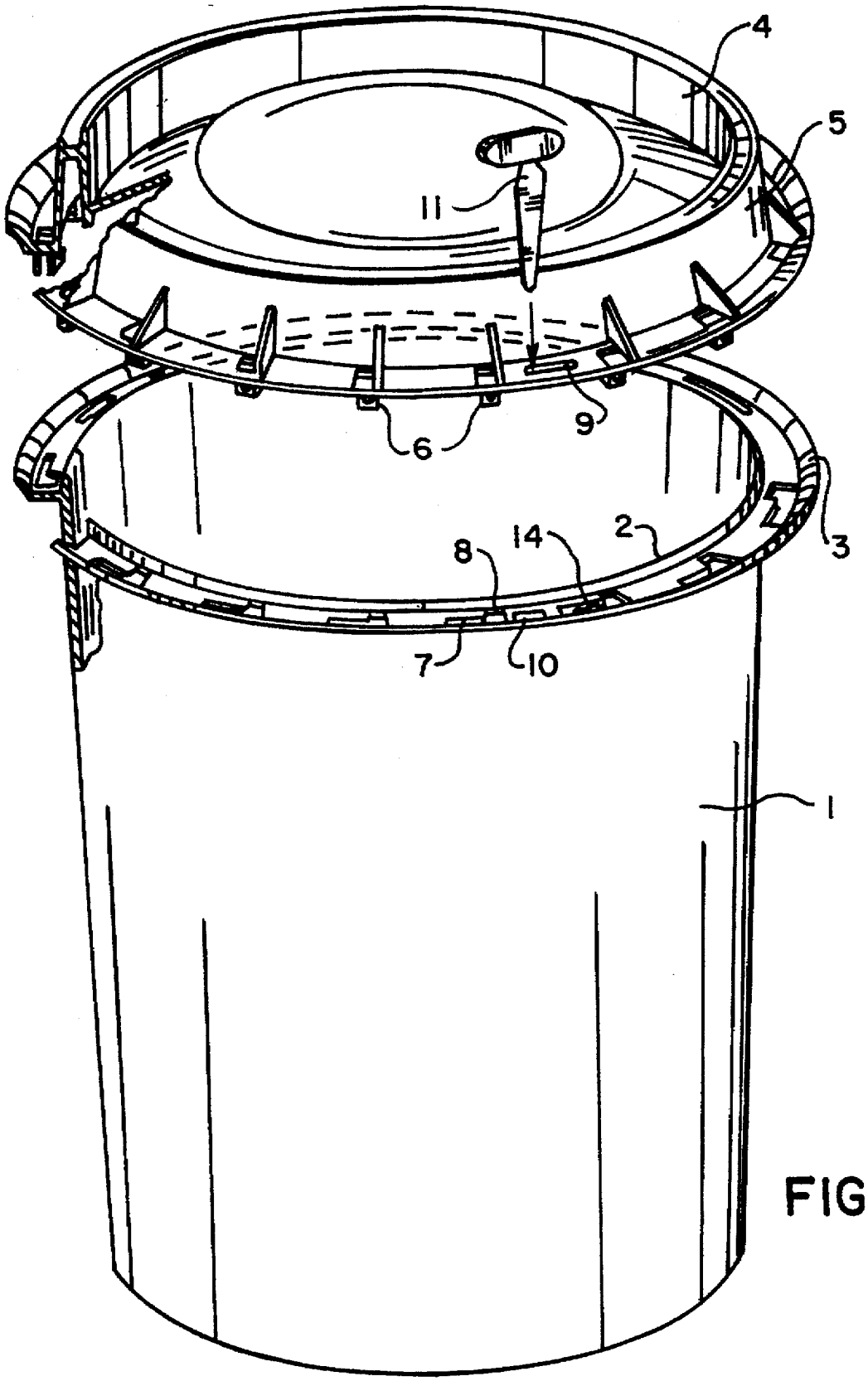
FIG. 1 shows a perspective view of a container with associated cover provided with a closing device according to the invention.

As shown in FIG. 1, designated with the numeral 1 is the container which here is of circular cross section and is provided on the top along the upper rim 2 thereof with an outward directed flange 3. The cross section of the flange is random and is shown here as being slightly V-shaped.

The cover 4 here has a hat-like shape and is likewise embodied along the bottom rim thereof with a corresponding flanged counter edge 5, the cross section of which is slightly V-shaped in likewise manner to that of the flanged edge 3.

It will be apparent that the form of the container and the cover is further of random nature and falls beyond the scope of the invention.

Figure 2:
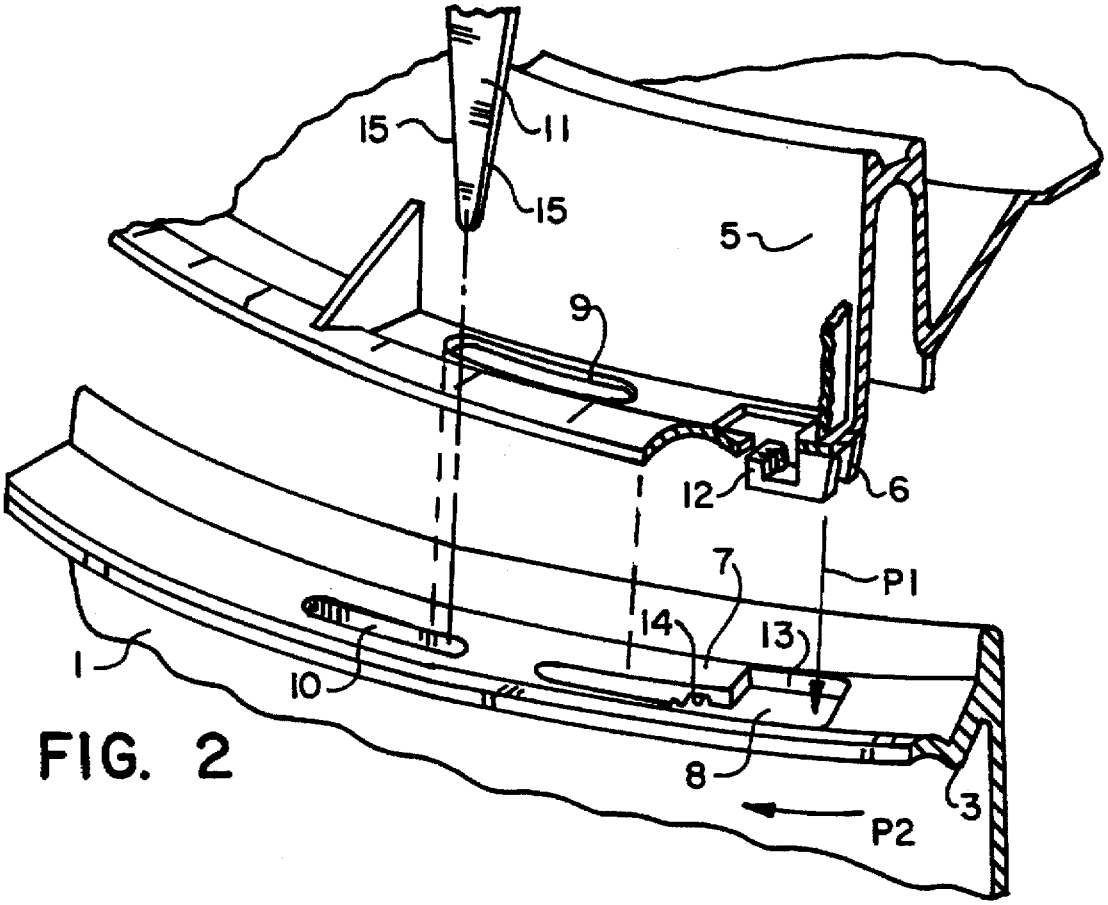
FIGS. 2 and 3 show a detail of the cover and the container of FIG. 1 on enlarged scale in the open and locked positions, respectively.
Figure 3:
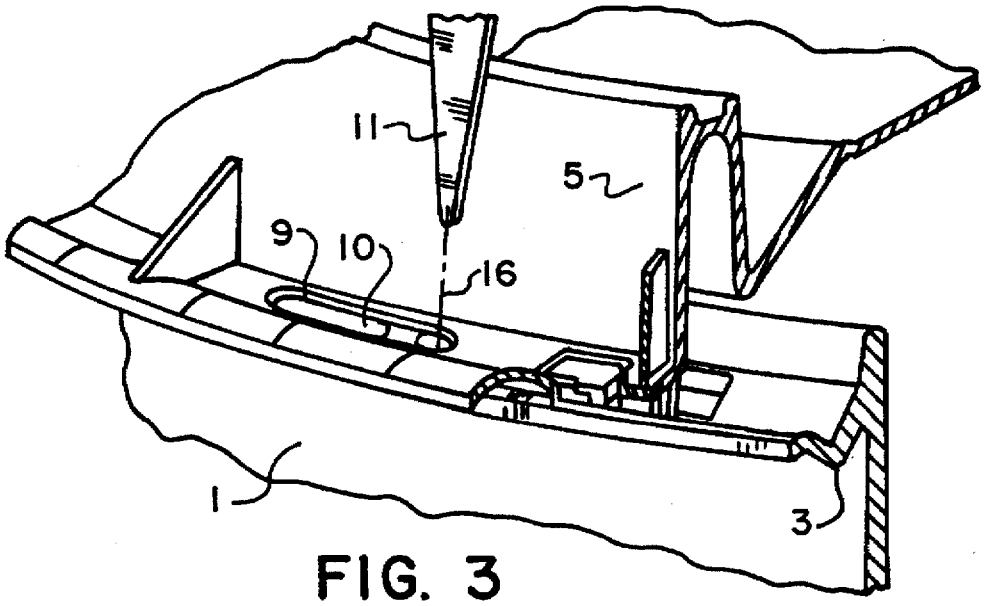

The cover can be locked onto container 1 by means of a number of cams 6 which are arranged on the underside of flanged edge 5 and which can come into engagement with counter cams 7 arranged in the flanged edge 3 of the container in the form of an edge of a continuous hole 8, which is further elucidated with reference to FIG. 2 and 3.

It will be apparent that as many cams 6 as counter-cams 7 are arranged and that by a small rotation of cover 4 relative to container 1 a locking can be effected between cam 6 and counter-cam 7, see below.

The flanged edge 3 and the flanged edge 5 are also embodied at a number of locations with slotted holes 9 and 10, respectively, which can fall into register when flanged edge 5 comes to lie on flanged edge 3. Such a slotted holes 9 and 10 serve to receive a hand-tool 11, the body of which takes a wedge-shaped form.

There now follows a description of the closing mechanism of the container of FIG. 1.

It can be seen clearly in FIG. 2 that the cam 6 has a hook-like shape, a nose 12 of which points upward. Counter-cam 7 is formed by an edge part of a slotted hole 8 which has a broad portion, designated with 13, for receiving cam 6 as according to arrow P1.

The underside of counter-cam 7 is provided with a recess 14 into which the nose 12 of cam 6 must eventually fall. This is brought about by placing the cover with flanged edge 5 onto the flanged edge 3 of the container, whereby cam 6 protrudes through the opening 13, and, by turning in the direction of the arrow P2, carrying the nose 12 of cam 6 into the recess 14. During this movement the cam 6 will deflect slightly outward in order to enable the nose 12 to travel along the underside of counter-cam 7. This will of course involve friction and a resistance force.

Since each cam 6 simultaneously comes into contact with counter-cam 7 this resistance force can increase considerably, and to overcome this resistance force a slotted holes 9 and 10 are arranged according to the invention in flanged edges 5 and 3, respectively. When cam 6 is placed in the hole 13 of slotted hole 8, the slotted hole 9 lies partially over slotted hole 10 so that a continuous opening is created. The tip of the wedge-shaped element 11 can be pushed into this continuous opening, wherein the side edges 15 of the wedge-shaped body 11 will want to press apart the slotted holes 9 and 10 such that they come to lie more in register.

During this shifting of slotted holes 9 and 10, the cover 4 will also rotate relative to container 1 and the cams 6 and 7 will come into mutual engagement.

In the locking position according to FIG. 3, slotted hole 9 lies relative to slotted hole 10 such that a right-hand portion of slotted hole 9 still lies above slotted hole 8, see at 16. By pressing hand-tool 11 with the edges 15 into the hole 16, the cover 4 can be rotated back again and cam 6 can be released from counter-cam 7, and the cover can be lifted again.

Figure 4:
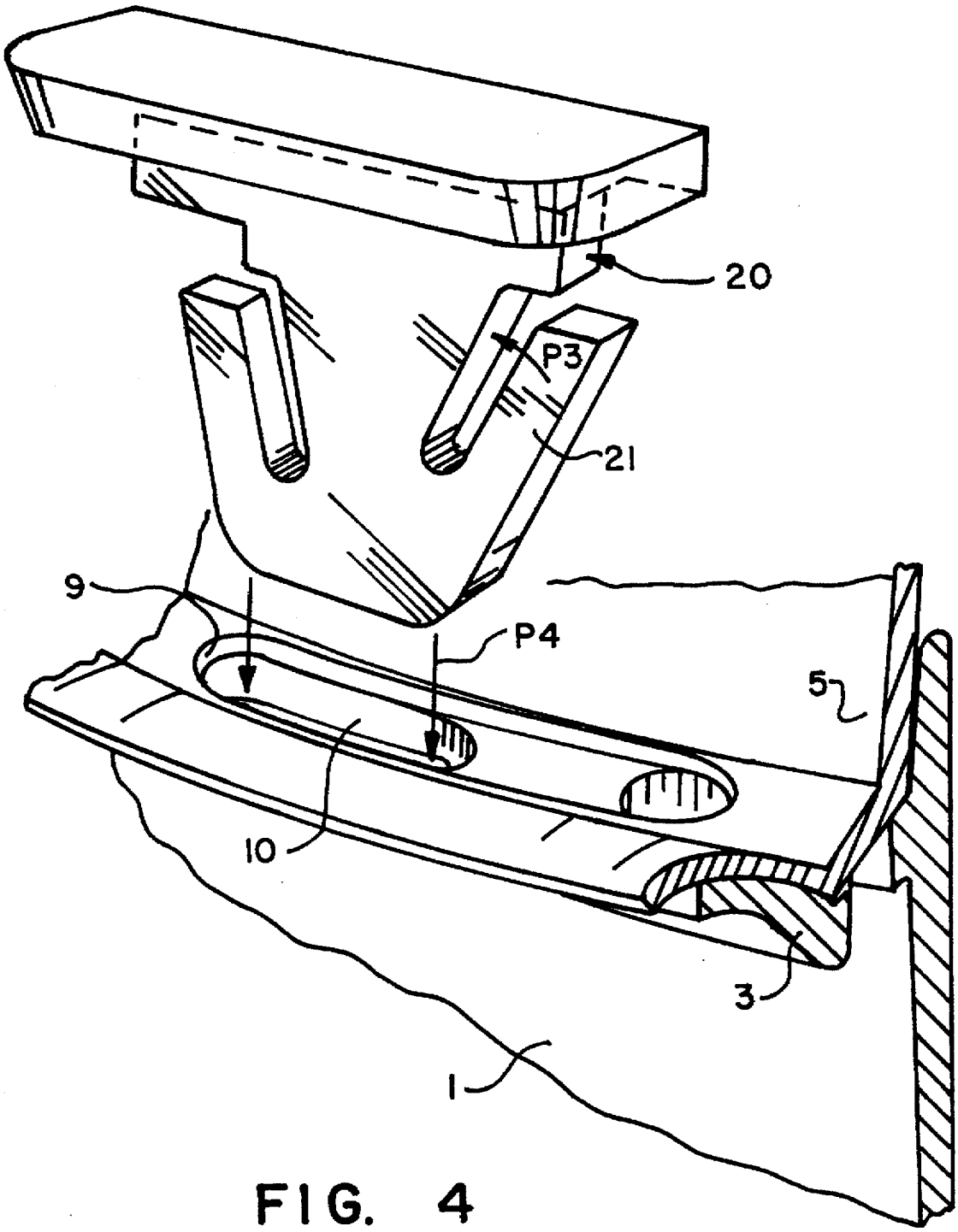
FIG. 4 is a perspective view corresponding with that of FIGS. 2 or 3, wherein a locking member for insertion into the slotted hole is shown.

In order to obtain a permanent locking, a locking element in the form of a wedge as according to FIG. 4 can be arranged. The locking element 20 has two fingers 21 in a V-shape which can deflect inward in the direction of arrow P3. When pressed as according to arrow P4 into the hole formed by the slotted holes 9 and 10 the body of the locking element 20 can be pushed wholly through the continuous opening. As soon as the end edge of the finger 21 has passed under flange 3 it deflects outward and the locking element 20 is definitively secured in the opening. A locking against rotation of the cover 4 relative to the container is hereby ensured.

We claim:

1. A closing mechanism for closing a cover onto a container in which the cover and the container each have a protruding flanged edge which come to lie against each other in a closed position, the closing mechanism comprising:

a hook-shaped cam connected to the cover;

a counter-cam connected to the container and configured to engage the cam to lock the cover onto the container;

at least one slotted hole located on the flanged edge of the cover; and at least one slotted hole located on the flanged edge of the container, wherein a portion of the slotted hole in the cover overlaps a portion of the slotted hole in the container such that a wedge-shaped hand-tool removably inserted into the overlapping portions of the slotted holes in the flanged edges to turn the cover in relation to the container such that the hook-shaped cam connected to the cover engages the counter-cam to lock the cover onto the container.

2. The closing mechanism as claimed in claim 1, wherein the hook-shaped cam of the cover protrudes below the flanged edge of the cover and the flanged edge of the container includes a locking hole, with an edge of the locking hole forming the counter-cam.

3. The closing mechanism as claimed in claim 2, wherein a wedge-shaped locking element can be inserted into the mutually overlapping slotted holes in the cover and the container to permanently lock the cover onto the container.

4. The closing mechanism as claimed in claim 1, wherein a wedge-shaped locking element can be inserted into the mutually overlapping slotted holes in the cover and the container to permanently lock the cover onto the container.

5. A closing mechanism for locking a cover onto a container in which the cover and the container each have a protruding flanged edge which come to lie against each other in a closed position, the closing mechanism comprising:

a hook-shaped cam connected to the cover;

a counter-cam connected to the container and configured to engage the cam to lock the cover onto the container;

at least one slotted hole located on the flanged edge of the cover; and at least one slotted hole located on the flanged edge of the container, wherein a portion of the slotted hole in the cover overlaps a portion of the slotted hole in the container such that a wedge-shaped hand-tool can be placed in the overlapping portions of the slotted holes in the flanged edges to turn the cover in relation to the container such that the hook-shaped cam connected to the cover engages the counter-cam to lock the cover onto the container, wherein the hook-shaped cam of the cover protrudes below the flanged edge of the cover and the flanged edge of the container includes a locking hole, with an edge of the locking hole forming the counter-cam, and wherein a portion of the locking hole overlaps a portion of the slotted hole in the cover in the closed position.

6. The closing mechanism as claimed in claim 5, wherein a wedge-shaped locking element can be inserted into the mutually overlapping slotted holes in the cover and the container to permanently lock the cover onto the container.

7. The closing mechanism as claimed in claim 5, wherein the wedge-shaped hand-tool can be placed in the overlapping portions of the locking hole and the slotted hole of the cover to turn the cover in relation to the container such that the cam of the cover disengages the counter-cam of the container to unlock the cover from the container.

* * * * *